US007149467B2

(12) United States Patent
Stickler et al.

(10) Patent No.: US 7,149,467 B2
(45) Date of Patent: Dec. 12, 2006

(54) WASTE TONER SYSTEM FOR AN IMAGE FORMING DEVICE

(75) Inventors: Tom E Stickler, Lexington, KY (US); Larry Steven Foster, Lexington, KY (US); Michael Craig Leemhuis, Nicholasville, KY (US); Benjamin Alan Askren, Lexington, KY (US)

(73) Assignee: Lenmark International, Inc., Lexington, KY (US)

( * ) Notice: Subject to any disclaimer, the term of this patent is extended or adjusted under 35 U.S.C. 154(b) by 89 days.

(21) Appl. No.: 10/811,210

(22) Filed: Mar. 26, 2004

(65) Prior Publication Data

US 2005/0214046 A1 Sep. 29, 2005

(51) Int. Cl.
*G03G 21/12* (2006.01)
*G03G 21/18* (2006.01)

(52) U.S. Cl. ..... 399/358; 399/107; 399/35; 399/123; 399/360

(58) Field of Classification Search ..... 399/358, 399/360, 120, 123, 35
See application file for complete search history.

(56) References Cited

U.S. PATENT DOCUMENTS

| | | | | | |
|---|---|---|---|---|---|
| 3,641,980 | A | * | 2/1972 | Bickmore | 399/269 |
| 3,911,863 | A | * | 10/1975 | Herzhoff et al. | 118/68 |
| 4,218,132 | A | * | 8/1980 | Iwai et al. | 399/358 |
| 4,478,512 | A | * | 10/1984 | Zoltner | 399/106 |
| 4,519,693 | A | * | 5/1985 | Skeels | 399/262 |
| 4,819,578 | A | * | 4/1989 | Koiso et al. | 399/360 |
| 4,849,791 | A | | 7/1989 | Hagihara et al. | |
| 4,860,056 | A | | 8/1989 | Kano et al. | |
| 4,941,022 | A | | 7/1990 | Ohmura et al. | |
| 4,974,031 | A | * | 11/1990 | Koiso et al. | 399/360 |
| 5,130,756 | A | | 7/1992 | Taniyama | |
| 5,132,740 | A | | 7/1992 | Okamoto et al. | |
| 5,270,785 | A | | 12/1993 | Kita et al. | |
| 5,272,511 | A | * | 12/1993 | Conrad et al. | 399/382 |
| 5,383,578 | A | | 1/1995 | Nishimura | |
| 5,402,216 | A | | 3/1995 | Komaki et al. | |
| 5,440,376 | A | | 8/1995 | Hagihara | |
| 5,444,522 | A | | 8/1995 | Owens, Jr. | |
| 5,534,988 | A | * | 7/1996 | Gerbasi | 399/358 |
| 5,594,541 | A | | 1/1997 | Bonislawski, Jr. et al. | |
| 5,708,952 | A | | 1/1998 | Taniguchi et al. | |
| 5,933,690 | A | | 8/1999 | Sugimoto et al. | |
| 6,014,541 | A | | 1/2000 | Kato et al. | |
| 6,055,405 | A | | 4/2000 | Knott et al. | |
| 6,085,062 | A | | 7/2000 | Mizuishi et al. | |
| 6,266,511 | B1 | | 7/2001 | Murakami et al. | |
| 6,466,763 | B1 | * | 10/2002 | Campbell et al. | 399/360 |
| 2003/0219292 | A1 | | 11/2003 | Serlzawa et al. | |
| 2004/0052559 | A1 | * | 3/2004 | Jeong et al. | 399/358 |
| 2004/0161272 | A1 | * | 8/2004 | Park et al. | 399/358 |

* cited by examiner

*Primary Examiner*—Gail Verbitsky
(74) *Attorney, Agent, or Firm*—Coats and Bennett, PLLC

(57) ABSTRACT

A waste toner removal system for an image forming device. The invention includes a mechanism for removing the waste toner from the cartridge and transporting it through a toner chute to a waste toner tank. One or more actuators within the device allow for the connection between the various elements to seal the waste toner path and prevent toner leakage. Methods of moving waste toner are also disclosed that include moving the waste toner through the cartridge and into a waste toner chute. The waste toner is moved through the chute and into a waste toner tank where it may be removed from the device.

26 Claims, 9 Drawing Sheets

WASTE TONER SYSTEM FOR AN IMAGE FORMING DEVICE

BACKGROUND

During the image forming process, inefficiencies from the photoconductive member to the media create waste toner. The waste toner should be removed from the photoconductive member to prevent print quality problems. Previous devices have stored the waste toner in an area adjacent to the photoconductive member. Other designs require that the waste toner be moved away from the photoconductive member to a remote area within the device.

The waste removal elements should be constructed to be as small as possible. The overall size of the image forming device may result from the size of the waste removal elements. Larger waste removal elements may require other elements within the device to have increased sizes, such as the imaging unit, media path, and covers. It has further been determined that the overall size of the image forming device is a major purchasing factor for consumers. Smaller devices are preferred because they are easier to handle, and do not require as much space within workspaces. Additionally, the increase in size of these elements may greatly increase the overall cost of the device, as it has been determined that the cost increases as a function of size in more of an exponential rather than linear fashion.

The waste removal elements should also efficiently move the waste toner from the photoconductive members to an area of the machine where it can be stored for removal. This movement may require the waste toner to be moved through different areas of the machine. The movement is made more difficult because the waste toner may move through sections of the machine that are removable from the image forming device. The waste removal elements should be designed to account for sections of the waste toner path being removed, and still prevent toner leakage.

SUMMARY

The present invention is directed to a waste toner removal system for an image forming device. The invention includes a mechanism for removing the waste toner from the cartridge and transporting it through a toner chute to a waste toner tank. One or more actuators within the device allow for the connection between the various elements to seal the waste toner path and prevent toner leakage.

DETAILED DESCRIPTION

Figure 1:
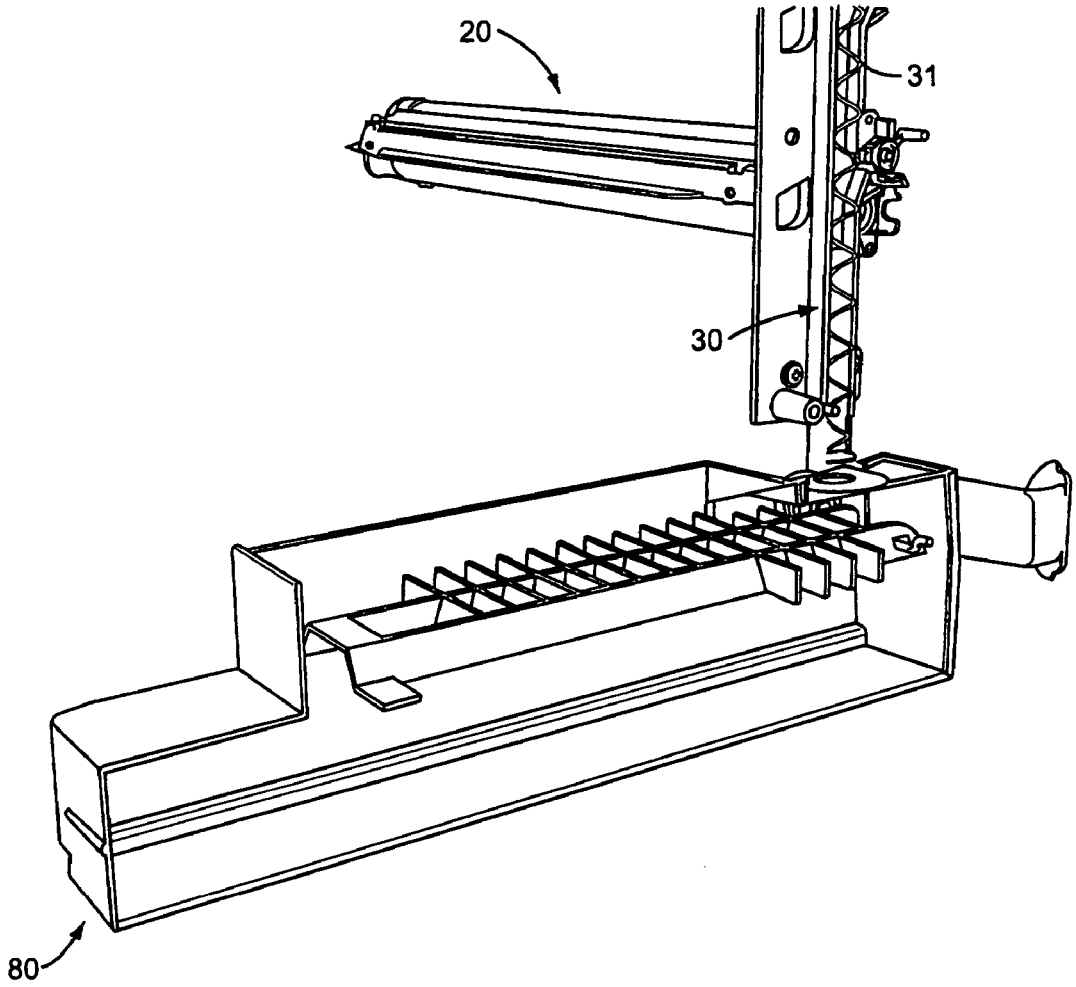
FIG. 1 is a partial cut-away perspective view of a section of the waste toner system according to one embodiment of the present invention.

The present invention is directed to a waste toner system within an image forming device as generally illustrated in FIG. 1. The system includes a cartridge 20 having an auger for moving waste toner away from a photoconductive member. A waste toner chute 30 (shown in cutaway) is operatively connected with the cartridge 20 to receive the waste toner. The waste toner chute 30 includes an auger 31 for moving the waste toner. An actuator 40 (FIGS. 6 and 7) is positionable between first and second orientations to control the opening and closing of the cartridge door 27. A waste toner receptacle 80 is positioned at an outlet of the waste toner chute 30 for storing the waste toner. A frame 60 (illustrated in FIGS. 11 and 12) of the image forming device supports the waste toner system.

Figure 2:
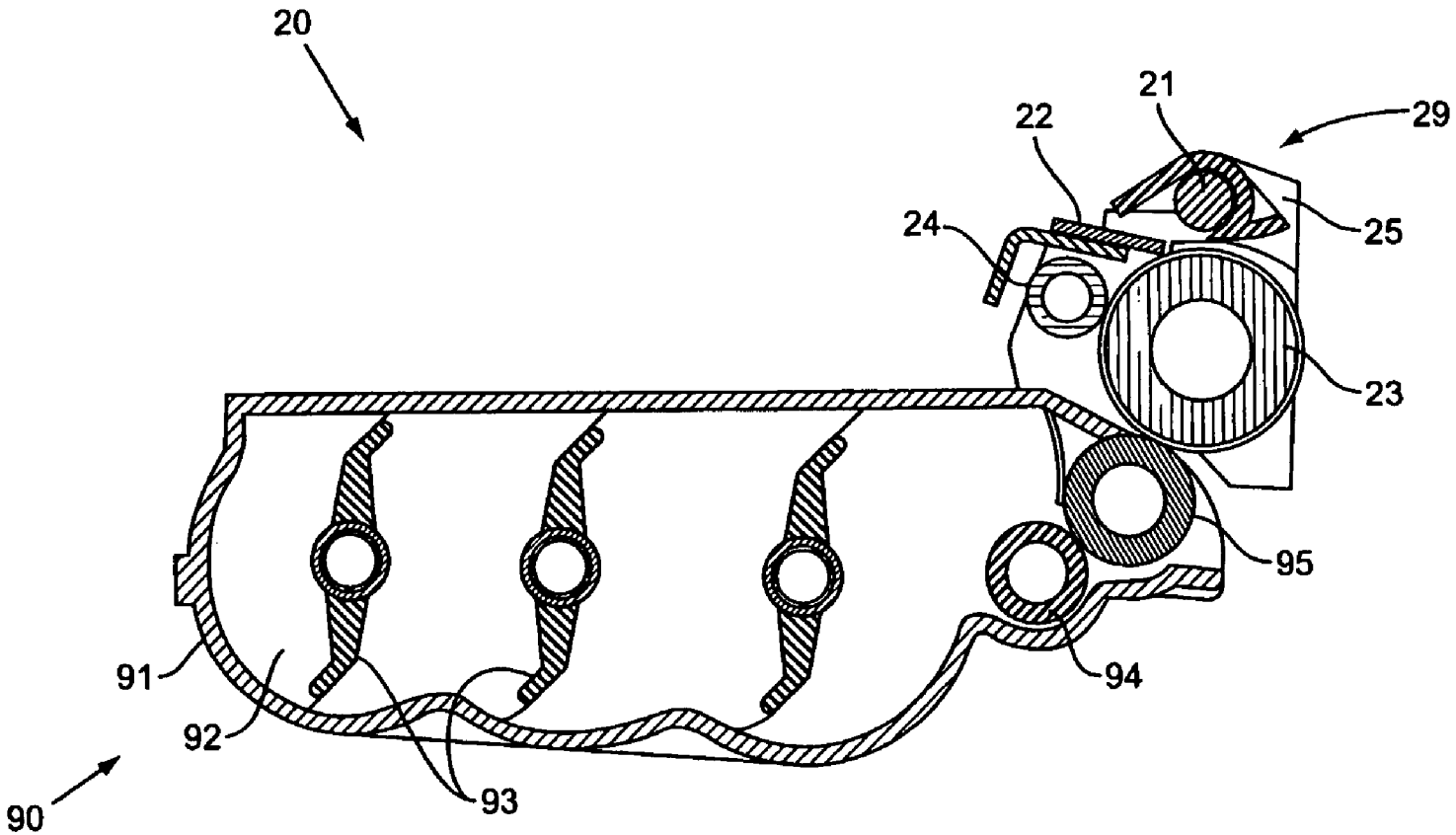
FIG. 2 is a schematic view of a cartridge according to one embodiment of the present invention.

FIG. 2 illustrates a cross-sectional view of the cartridge 20. The cartridge 20 comprises a developer section 90 and a cleaner section 29. The developer section 90 comprises an exterior housing 91 that forms a reservoir 92 for holding a supply of unused toner. One or more agitating members 93 are positioned within the reservoir 92 for agitating and moving the unused toner towards a toner adder roll 94 and the developer member 95. Unused toner moves from the reservoir 92 via the one or more agitating members 93, to the toner adder roll 94, and finally is distributed to the developer member 95.

The cleaner section 29 comprises an exterior housing 25 and a photoconductive member 23. In one embodiment, the photoconductive member 23 is an aluminum hollow-core drum coated with one or more layers of light-sensitive organic photoconductive materials. A cleaner blade 22 contacts the surface of the photoconductive member 23 to remove residual toner (i.e., waste toner) that remains on the photoconductive member 23. The waste toner is moved to a waste toner auger 21 and transported into the waste toner chute 30.

The cartridge 20 may be constructed of two separate pieces that are positioned together within the image forming device. In one embodiment, the developer section 90 comprises the first piece, and the cleaner section 29 comprises the second piece. One embodiment of a two piece cartridge is disclosed in U.S. patent application Ser. No. 10/804,628 entitled "Movable Subunit and Two Piece Cartridge for Use in an Image Forming Device", assigned to Lexmark International, Inc., and herein incorporated by reference in its entirety. In another embodiment, the cartridge 20 is a single piece having a construction similar to laser printer Model Nos. C750 and C752 available from Lexmark International, Inc., of Lexington, Ky.

Figure 3:
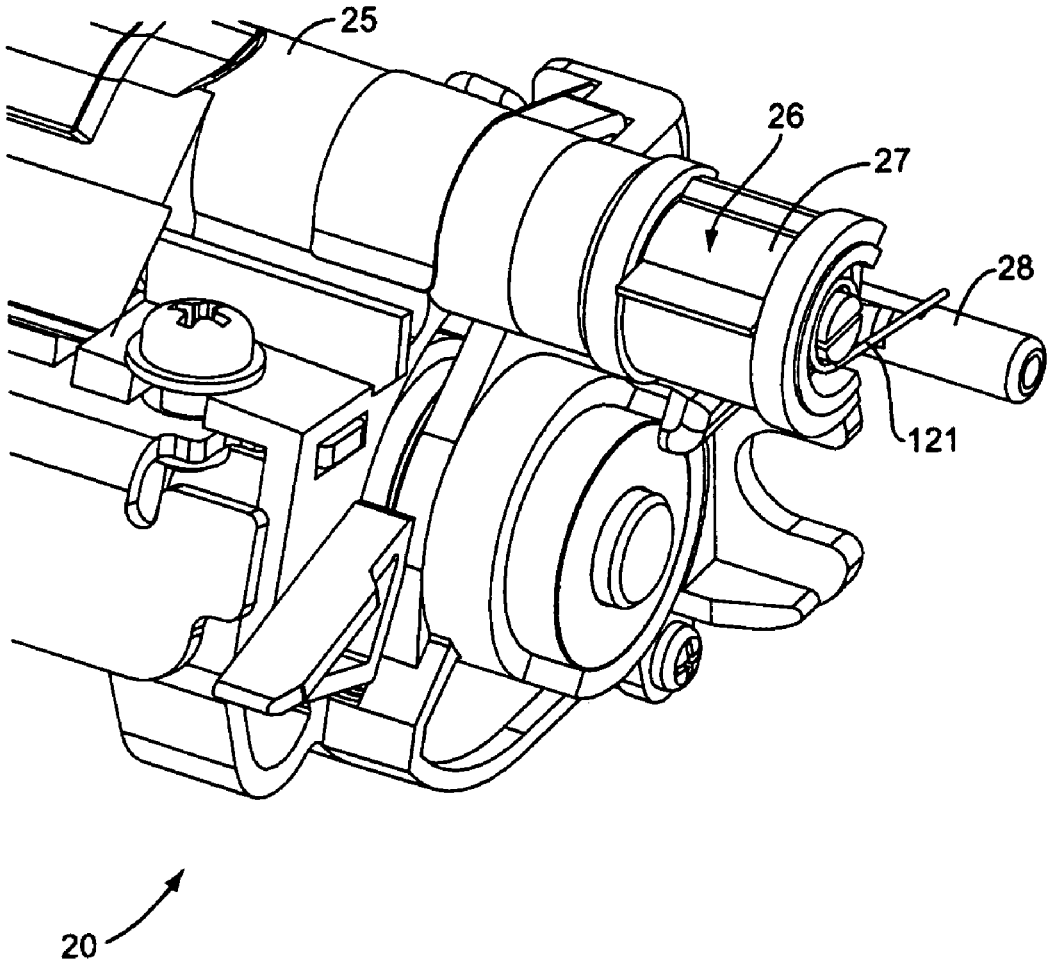
FIG. 3 is a partial perspective view of the cartridge and waste toner port according to one embodiment of the present invention.

FIG. 3 illustrates an end of the cartridge 20 that connects with the toner chute 30 (not illustrated). A waste toner port 26 provides a conduit for the waste toner to exit the cartridge 20 and enter into the waste toner chute 30. A door 27 is movably positioned over the port 26 between open and closed orientations, with FIG. 3 illustrating the door 27 in the closed orientation. A handle 28 is connected to the door 27. The handle 28 extends outward from the cartridge 20 and is contacted by the actuator 40 to control the orientation of the door 27 as will be discussed in detail below. A biasing mechanism 121 is positioned between the handle 28 and door 27. The biasing mechanism 121 positions the door 27 in the closed orientation when the cartridge 20 is removed from the waste toner chute 30 to prevent toner leakage. Seals may be positioned on each side of the port 26 to prevent toner leakage when the cartridge 20 is mounted to the waste toner chute 30.

Figure 4:
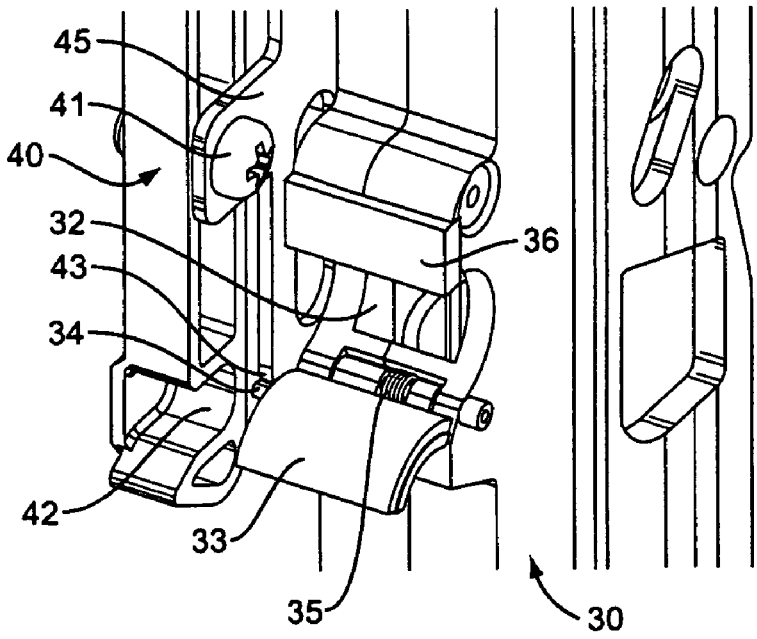
FIG. 4 is a partial front perspective view of the waste toner chute with the door in an open orientation according to one embodiment of the present invention.
Figure 5:
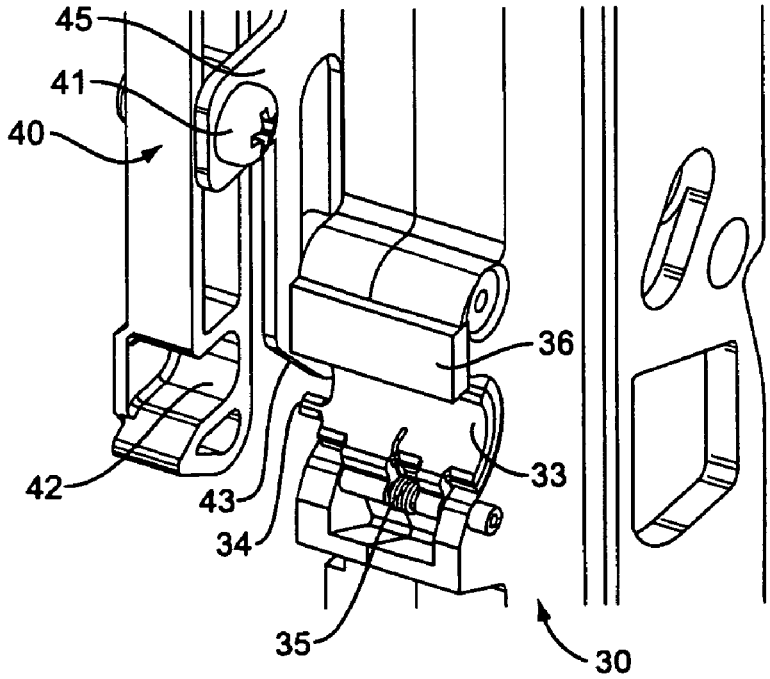
FIG. 5 is a partial front perspective view of the waste toner chute with the door in a closed orientation according to one embodiment of the present invention.

FIGS. 4 and 5 illustrate a front view of the waste toner chute 30. The waste toner chute 30 includes an inlet 32 for receiving the waste toner from the cartridge 20. A door 33 is positioned adjacent to the inlet 32 and is positionable between an open orientation as illustrated in FIG. 4, and a closed orientation as illustrated in FIG. 5. The door 33 is sized to cover the inlet 32 to prevent toner leakage while in the closed orientation. A biasing mechanism 35, such as a spring, is attached to the door 33 to bias it towards the closed orientation. One or more seals 36 may be positioned adjacent to the inlet 32 to prevent toner leakage when the cartridge 20 is mounted to the waste toner chute 30. Door 33 further includes an extension 34 that extends outward from one side adjacent to the actuator 40.

A cartridge door actuator 40 is movably mounted to the frame 60 (illustrated in FIGS. 11 and 12) between a first orientation as illustrated in FIG. 4, and a second orientation as illustrated in FIG. 5. In one embodiment, attachments 41 such as screws fixedly connect the cartridge door actuator 40 to a waste toner chute door actuator 45. A catch 42 in the actuator 40 is sized to receive the handle 28 to control the orientation of the cartridge door 27. In one embodiment, catch 42 is substantially a C-shaped opening having a back wall and two opposing walls. The handle 28 fits within the open side when the cartridge is mounted to the image forming device. Actuator 45 includes a contact section 43 that contacts the extension 34 on the waste toner chute door 33. In one embodiment as illustrated in FIGS. 4 and 5, contact section 43 comprises an edge of the actuator 45. When the actuator 45 is in the first orientation as illustrated in FIG. 4, contact section 43 abuts against the extension 34 to open the door 33. When the actuator 45 is in the second orientation as illustrated in FIG. 5, contact section 43 is distanced from the extension 34 and the biasing mechanism 35 forces the door 33 to the closed position.

Figure 6:
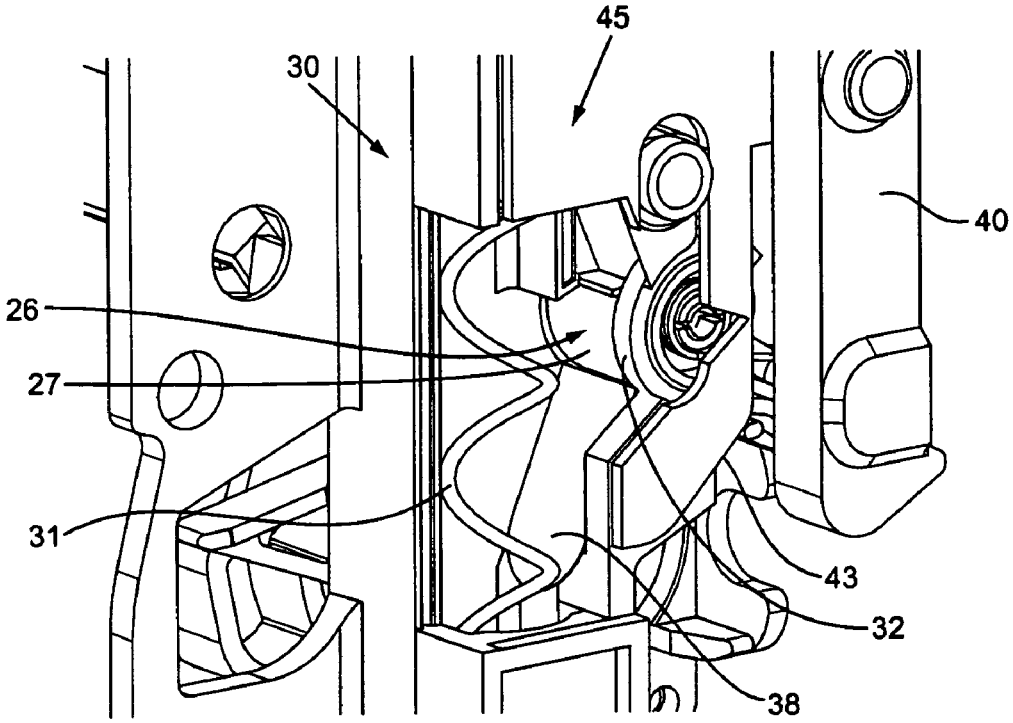
FIG. 6 is a partial rear perspective view of the cartridge mounted to the waste toner chute with the waste toner port in a closed orientation according to one embodiment of the present invention.
Figure 7:
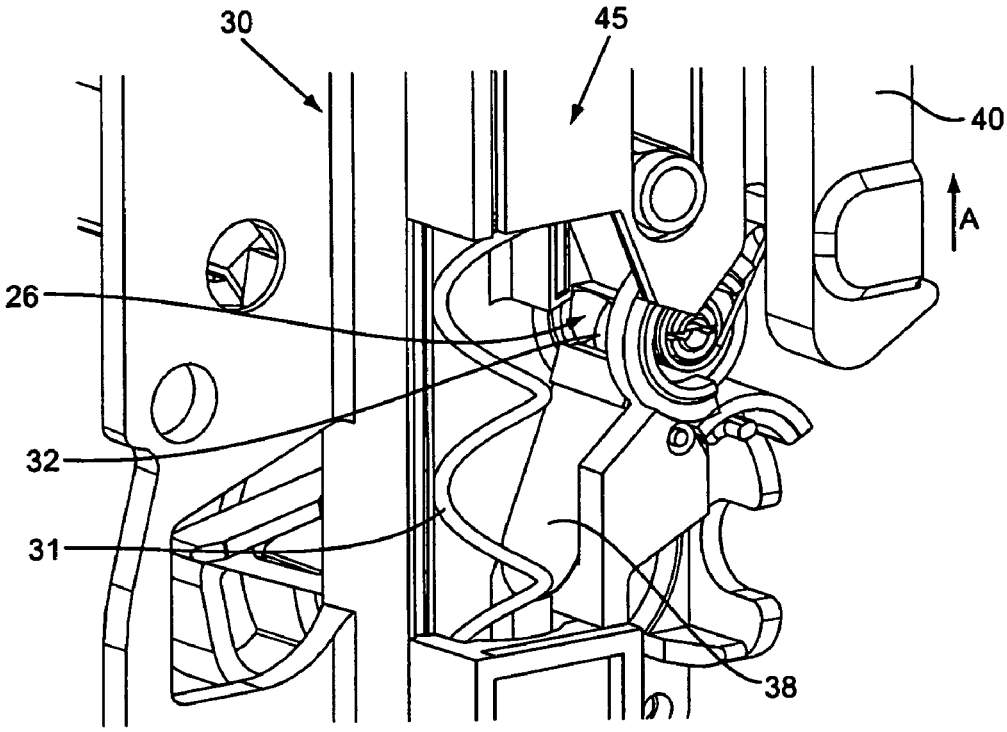
FIG. 7 is a partial rear perspective view of the cartridge mounted to the waste toner chute with the waste toner port in an open orientation according to one embodiment of the present invention.
Figure 8:
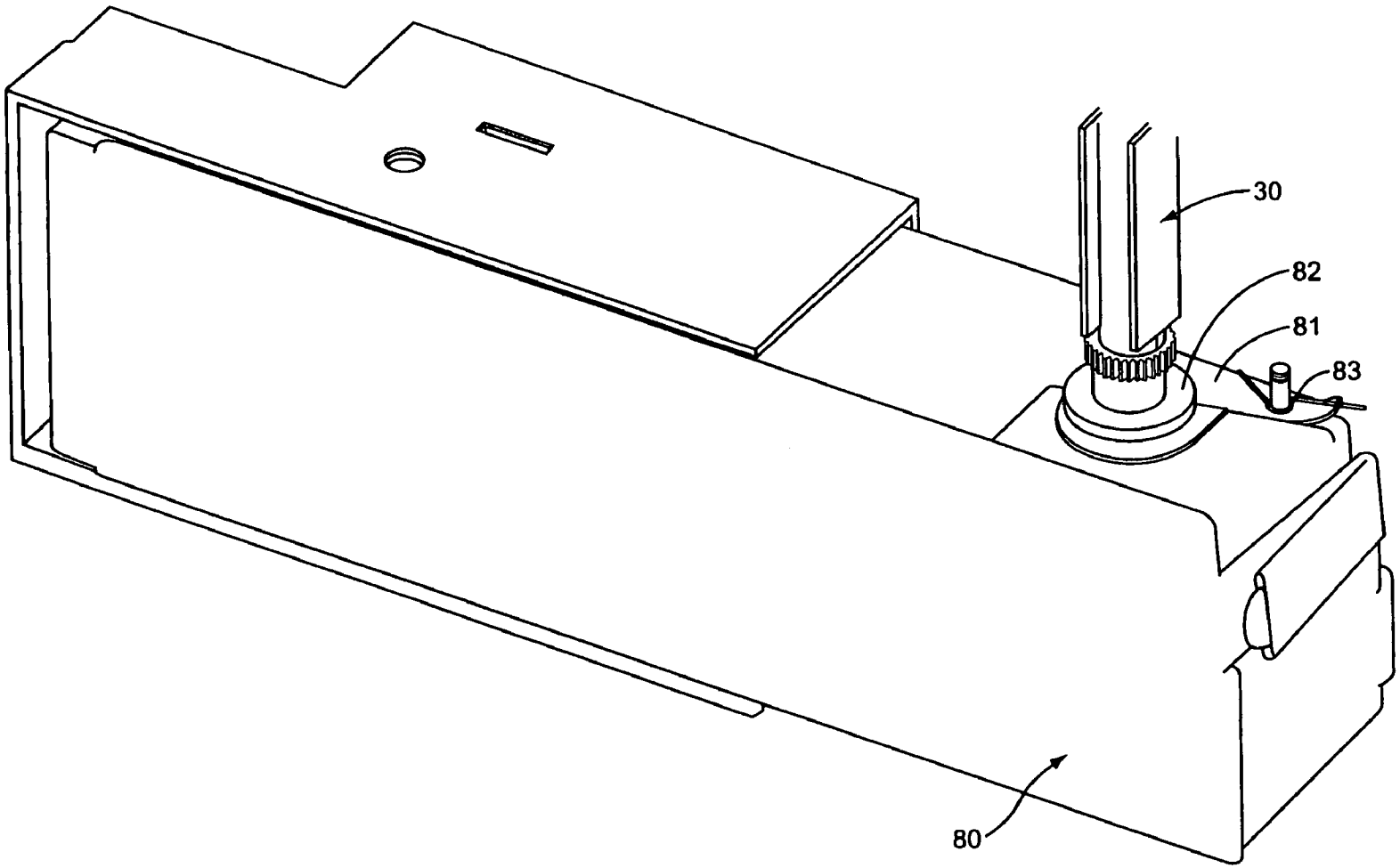
FIG. 8 is a partial perspective view of the waste toner chute connected to a waste toner tank according to one embodiment of the present invention.

FIGS. 6 and 7 illustrate a rear view of the cartridge 20 mounted to the waste toner chute 30. In these Figures, a section of the waste toner chute 30 and actuator 45 has been removed for clarity to permit viewing of the interior of the chute and the connection between the waste toner chute 30 and cartridge 20. In FIG. 6, the cartridge 20 is positioned with the port 26 aligned with the inlet 32 of the waste toner chute 30. The actuator 40 is in the first orientation and the door 27 is positioned across the port 26. With the actuator 45 in the first orientation when the cartridge 20 is mounted, door 33 on the waste toner chute 30 is maintained in the open orientation (as illustrated in FIG. 4). The cartridge 20 blocks the door 33 in the open orientation, even when the actuator 45 moves to the second orientation. Seals on the cartridge 20 and waste toner chute 30 extend around the connection of the port 26 and inlet 32 to prevent toner leakage. Once mounted, the cartridge handle 28 is positioned within the actuator catch 42.

FIG. 7 illustrates the cartridge door 27 in the open orientation to expose the waste toner port 26. The actuator 40 has been moved in the direction indicated by arrow A to the second orientation and the door 27 has rotated away from the port 26. Waste toner moving along the cartridge 20 by the auger 21 is moved through the port 26 and into the waste toner chute 30.

Auger 31 extends along the waste toner chute 30 to move the toner towards the waste toner tank 80. In one embodiment, auger 31 is a helically-shaped wire. It is understood that various other auger embodiments may also be used for moving the waste toner along the waste toner chute 30. A flap member 38 may be positioned within the waste toner chute 30 to prevent toner clogging. The flap member 38 may be a piece of stiff plastic film attached in the throat of the chute 30 between the inlet 32 and the auger 31. A top edge of the flap member 38 is mounted adjacent to the inlet 32, and a bottom edge extends into the path of the auger 31. During operation, the rotation of the auger 31 catches the bottom edge and deflects the member 38 downward. Auger 31 continues to deflect downward until it snaps back upward towards its original position. The deflection and snap create motion to break up any bridged waste toner that may be clogging within the throat.

The waste toner box 80 is positioned at an end of the waste toner chute 30. Preferably, the waste toner chute 30 is vertically positioned with the box 80 at a lower end to allow for gravity to assist in the waste toner movement. The waste toner box 80 is sized to accommodate waste toner from a plurality of cartridges 20 mounted along the waste toner chute 30. In one embodiment, four separate cartridges input waste toner into the waste toner chute 30 and the waste toner box 80. The waste toner box 80 may be removable from the image forming device, and should be removably mounted to the waste toner chute 30. A shutter 81 positioned adjacent to the lower end closes the waste toner chute 30 when the waste toner box 80 is removed from the image forming device. A biasing member 83 moves the shutter 81 to the closed orientation when the box 80 is removed. A seal 82 on the shutter 81 contacts the waste toner chute 30 to create a compliant connection to prevent toner leakage.

Figure 9:
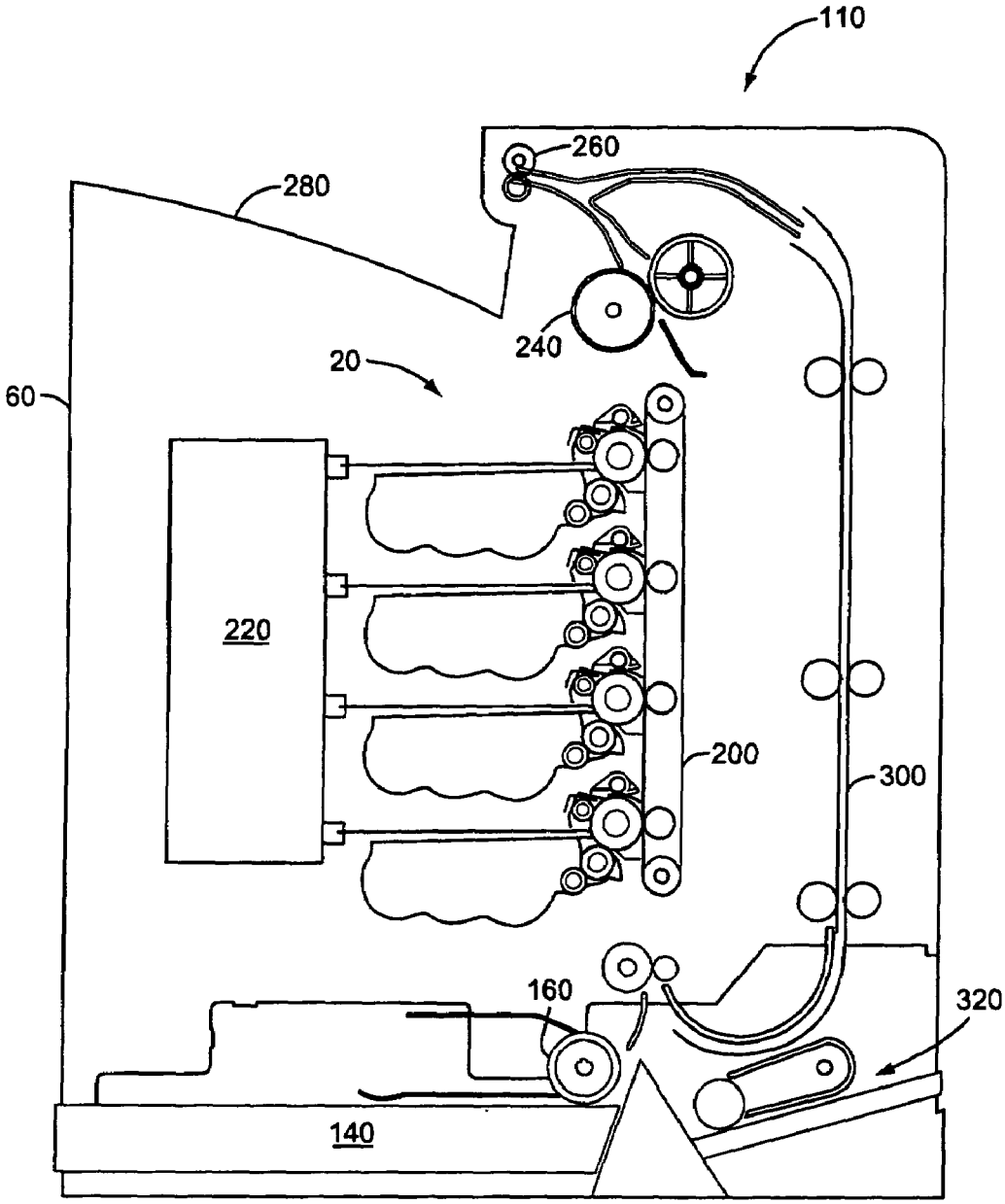
FIG. 9 is a schematic view of an image forming device constructed according to one embodiment of the present invention.

FIG. 9 depicts a representative image forming device, such as a printer, indicated generally by the numeral 110. A media tray 140 with a pick mechanism 160, or a manual input 320, are conduits for introducing media sheets in the device 110. The media tray 140 is preferably removable for refilling, and located on a lower section of the device 110.

Media sheets are moved from the input and fed into a primary media path. One or more registration rollers disposed along the media path aligns the print media and precisely controls its further movement along the media path. A media transport belt 200 forms a section of the media path for moving the media sheets past the plurality of cartridges 20. Color printers typically include four cartridges for printing with cyan, magenta, yellow, and black toner to produce a four-color image on the media sheet.

An imaging device 220 forms an electrical charge on a photoconductive member within the cartridges 20 as part of the image formation process. The media sheet with loose toner is then moved through a fuser 240 that adheres the toner to the media sheet. Exit rollers 260 rotate in a forward or a reverse direction to move the media sheet to an output tray 280 or a duplex path 300. The duplex path 300 directs the inverted media sheet back through the image formation process for forming an image on a second side of the media sheet.

The waste toner chute 30 is sized to accommodate each of the cartridges 20. In one embodiment, the waste toner chute 30 is vertically aligned with each of the cartridges 20 connecting at a different vertical position. The inlets 32 are laterally offset from a center part of the chute 30. Further, member 38 acts as a guide to move the toner away from the inlets 32 and towards the center part of the chute 30 where it is moved by the auger 31.

Toner leakage is further prevented by closing the toner chute doors 33 when the cartridge 20 is not mounted within the image forming device 110. This is especially important when a vertically higher cartridge is connected to the chute 30 and a lower connection is not occupied by a cartridge 20. Toner leakage may occur if the door 33 of the lower connection remained open while the vertically higher cartridge was moving toner into the chute 30. One embodiment of operating with fewer than a full set of cartridges occurs when the color cartridges (i.e., magenta, yellow, and cyan) are removed during monochromatic image formation and the image forming process operates with only the black cartridge.

Figure 10:
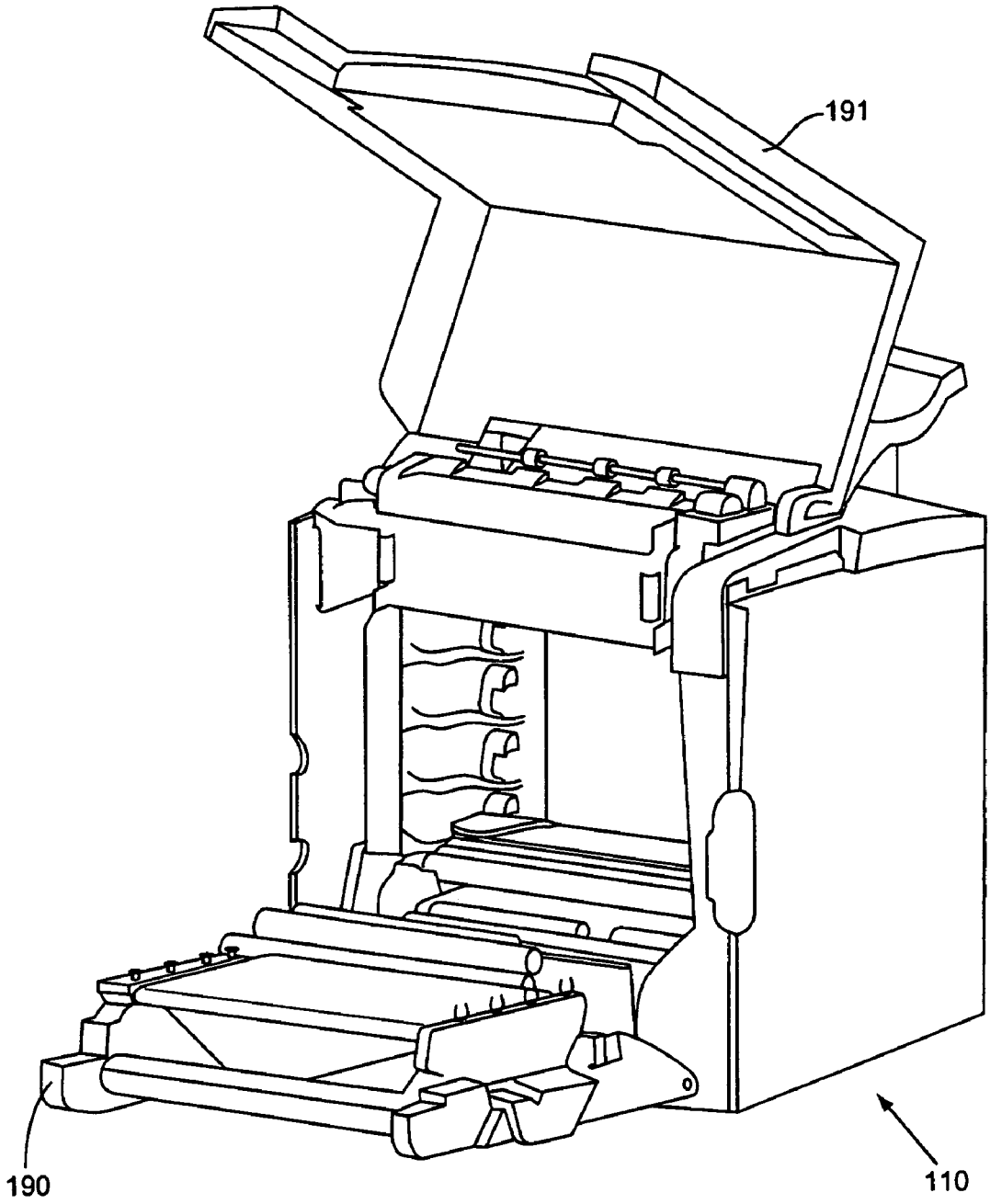
FIG. 10 is a perspective view of first and second covers in an open orientation according to one embodiment of the present invention.

FIG. 10 illustrates an external view of the image forming device 110 having a first door 190 and a second door 191. First door 190 is pivotally connected to the device and mounts the cleaner units 29 as the developer sections are mounted within the main body of the device 110. The first door 190 moves adjacent to the main body and mounts the cleaner units 29 such that each of the waste toner ports 26 is aligned with the corresponding inlet 32 of the waste toner chute 30.

Second door 191 extends over the first door 190 when both are in the closed orientation. Second door 191 is operatively connected to the actuator 40. Movement of the second door 191 between open and closed orientations moves the actuators 40, 45 between the first and second orientations. In the open position as illustrated in FIG. 10, actuators 40, 45 are in the first orientation as illustrated in FIG. 4 and the door 33 to each inlet on the toner chute 30 is open. After the first door 190 is closed and the second door 191 remains open, cartridges 20 are positioned with the waste toner ports 26 aligned with the inlets 32 as illustrated in FIG. 6. The second door 191 is then closed which moves the actuators 40, 45 to the second orientation as illustrated in FIG. 7 thus opening the doors 27 to the waste toner ports 26. For connections where cartridges 20 are not located, closing the second door 191 causes the corresponding waste toner door 33 to close as illustrated in FIG. 5.

Figure 11:
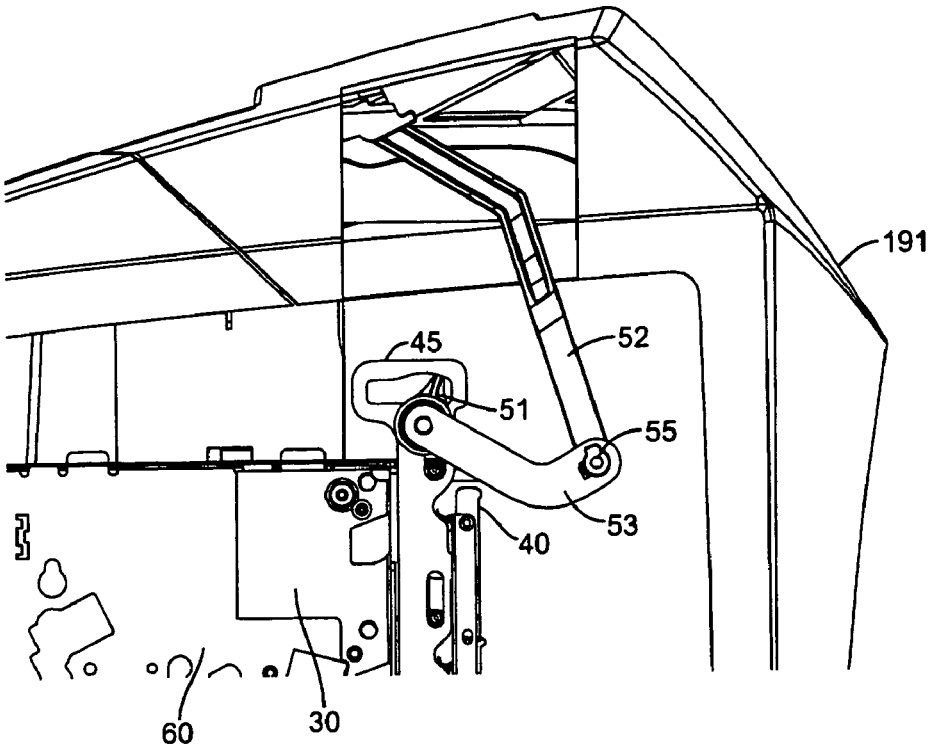
FIG. 11 is a partial side view of a second door in a closed orientation.
Figure 12:
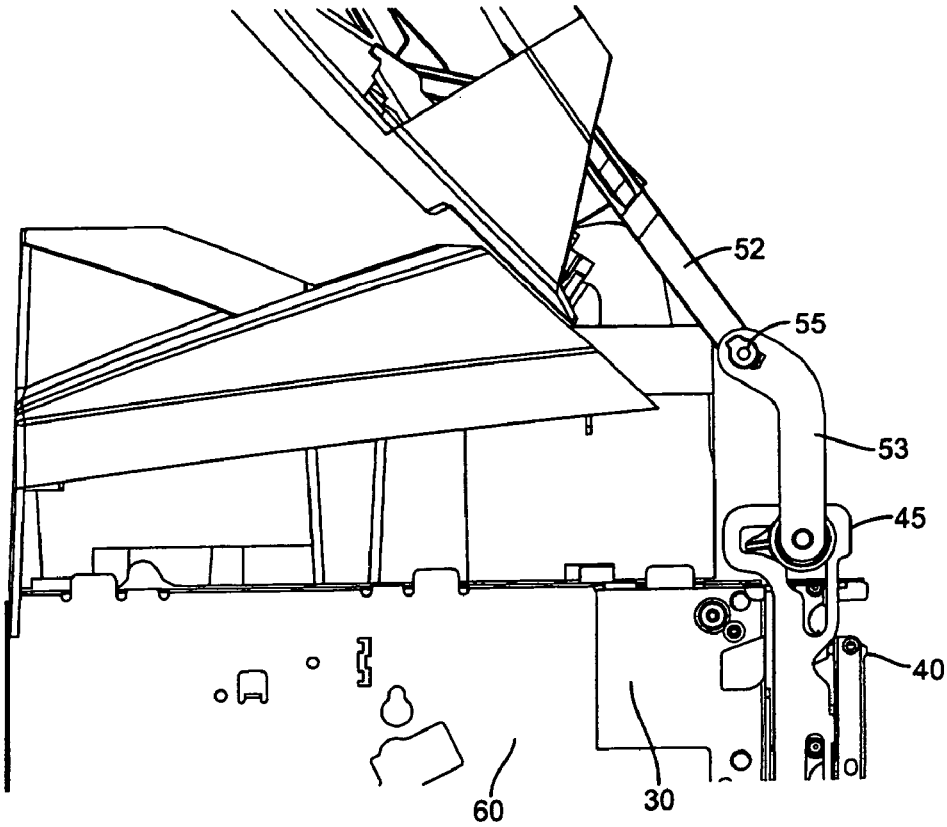
FIG. 12 is a partial side view of the second door in an open orientation.

FIGS. 11 and 12 illustrate the second door 191 being operatively connected to the actuator 45 and the fixedly attached actuator 40. A link 52 and link arm 53 extend between the second door 191 and the camshaft 51. The link arm 53 and camshaft 51 are fixedly attached to camshaft 51 which is constrained to rotate about its longitudinal axis. FIG. 12 illustrates the second door open and the actuators 40, 45 in the downward orientation (as illustrated in FIG. 4). FIG. 11 illustrates the second door 191 closed and the actuators 40, 45 in the upward orientation (as illustrated in FIG. 5). The upward orientation (i.e., second orientation) closes each of the waste toner chute doors 33 where no cartridges 20 are mounted. Movement of the second door 191 from the open to closed positions causes the pivotal connection point 55 between the link 52 and link arm 53 to rotate downward. Camshaft 51 transforms the rotary motion of the link 52 and link arm 53 to linear motion thus moving the actuator 45 and connected actuator 40 upward relative to the frame 60.

The term "image forming device" and the like is used generally herein as a device that produces images on a media sheet. Examples include but are not limited to a laser printer, ink-jet printer, fax machine, copier, and a multi-functional machine. One example of an image forming device is Model No. C750 referenced above.

The term "imaging device" refers to a device that arranges an electrical charge on the photoconductive element 23. Various imaging devices may be used such as a laser printhead and a LED printhead.

A transport belt 200 is illustrated in the embodiments for moving the media sheets past the cartridges 20, and as part of the subunit. In another embodiment, roller pairs are spaced along the media path. The roller pairs move the media sheets past the cartridges 20.

The present invention may be carried out in other specific ways than those herein set forth without departing from the scope and essential characteristics of the invention. The cleaner section 29 may also include a charger 24 that applies an electrical charge to the photoconductive member 23 to receive an electrostatic latent image from the imaging device. The present embodiments are, therefore, to be considered in all respects as illustrative and not restrictive, and all changes coming within the meaning and equivalency range of the appended claims are intended to be embraced therein.

What is claimed is:

1. A waste toner device for an image forming apparatus comprising:

a cartridge having an auger and a port, the auger rotates to move toner towards the port, the cartridge further comprising a cartridge door positionable between a closed orientation extending across the port to prevent the toner from escaping, and an open orientation to allow the toner to move through the port;

a toner chute having an inlet with a chute door positionable between opened and closed orientations to control the movement of the toner through the inlet;

an actuator positioned adjacent to the toner chute and positionable in first and second orientations, the first orientation being in contact with the chute door to position the chute door in the open orientation, and the second orientation in contact with the cartridge door to position the cartridge door in the open orientation; and a handle operatively connected to the cartridge door that is positioned within a catch in the actuator, the handle being contacted by the actuator when moving between the first and second orientations to move the cartridge door between the closed orientation and the open orientation.

2. The device of claim 1, wherein the auger is aligned substantially perpendicular to the toner chute.

3. The device of claim 1, wherein the cartridge further comprises a photoconductive member and a blade to remove the toner from the photoconductive member and move the toner into the auger.

4. The device of claim 1, further comprising a biasing mechanism to bias the cartridge door towards the closed orientation.

5. The device of claim 1, wherein the actuator comprises a first actuator to contact the chute door and a second actuator to contact the cartridge door.

6. The device of claim 1, wherein the toner chute further comprises an auger to move the toner towards an end of the toner chute.

7. The device of claim 6, wherein the toner chute and the auger are vertically positioned such that gravity assists in moving the toner towards the end of the waste toner chute.

8. The device of claim 7, further comprising a waste toner tank positioned at the end of the waste toner chute to collect the toner, the waste toner tank being removable from the image forming apparatus.

9. The device of claim 1, further comprising a flexible flap having a first end attached to the toner chute adjacent to the inlet and a second end that extends into a path of the auger to flex downward and rebound to prevent the toner from clogging within the waste toner chute.

10. The device of claim 1, further comprising an extension that extends outward from the chute door to contact the actuator in the first orientation to position the chute door in the open orientation.

11. The device of claim 1, wherein the actuator is vertically positioned to extend along a section of the toner chute and be attached to a frame of the image forming device.

12. The device of claim 11, wherein the actuator is operatively connected to a cover with movement of the cover positioning the actuator between the first and second orientations.

13. A waste toner removal device for an image forming apparatus comprising:

a cover movably mounted on the device and positionable between open and closed orientations;

a toner chute positioned within the device and having an inlet and a second inlet;

a cartridge mounted to the inlet of the toner chute and having an auger that moves toner from a photoconductive member towards a port having a port door; and an actuator mounted on the device and operatively connected to the cover and to the port door, the actuator positioned in a first position when the cover is in the open orientation with the port door being across the port to prevent toner from moving through the inlet, the actuator positioned in a second position when the cover is in the closed orientation to contact and position the port door away from the port to allow toner to move through the inlet;

the actuator operatively connected to a second chute door at the second inlet to position the second chute door across the second inlet when the actuator is in a closed position to prevent toner from moving through the second inlet.

14. The device of claim 13, further comprising a chute door adjacent to the inlet and sized to cover the inlet in the closed position and prevent toner from moving through the inlet when the cartridge is removed.

15. The device of claim 14, wherein the cartridge contacts the chute door when installed in the image forming apparatus to maintain the chute door in an open position.

16. A waste toner removal device for an image forming apparatus comprising:

a waste toner chute;

a first inlet within the waste toner chute having a first door;

a second inlet within the waste toner chute having a second door;

a cartridge having an auger, a waste toner port, and a cartridge door, the cartridge mounted to the waste toner chute with a waste toner port aligned with the first inlet and the cartridge positioned to maintain the first door in an open orientation away from the first inlet;

an actuator adjacent to the waste toner chute and positionable in a first position to maintain the second door in an open orientation away from the second inlet, and a second position to move the second door to a closed orientation across the second inlet and to open the cartridge door for toner to move along the auger and through the waste toner port and the first inlet.

17. The device of claim 16, further comprising a cover that is operatively connected to the actuator with movement of the cover causing the actuator to move between the first and second positions.

18. The device of claim 16, wherein the first inlet is vertically above the second inlet.

19. The device of claim 18, further comprising a waste toner tank at a bottom end of the toner chute vertically below the first inlet and the second inlet.

20. A method of removing toner from an image forming device, the method comprising the steps of:

moving a cover to an open position and opening an inlet and a second inlet in a waste toner chute;

mounting a cartridge within the image forming device with a waste toner port of the cartridge aligning with the inlet of the waste toner chute;

moving the cover to a closed position and moving a door positioned across the waste toner port on the cartridge to an open position and moving a second chute door across the second inlet; and moving waste toner along the cartridge and through the waste toner port on the cartridge and through the inlet into the waste toner chute.

21. The method of claim 20, wherein the step of moving the cover to the closed position moves an actuator positioned along the waste toner chute to contact and move the door to the open position.

22. The method of claim 20, wherein the step of moving the waste toner along the cartridge and through the waste toner port comprises positioning a blade in the cartridge against a photoconductive member in the cartridge and directing the waste toner with an auger within the cartridge.

23. The method of claim 20, further comprising rotating an auger within the waste toner chute and moving toner away from the waste toner port.

24. The method of claim 23, further comprising positioning a flap between the inlet of the waste toner chute and the auger to contact the auger and periodically flex and release to prevent the waste toner from clogging within the waste toner chute.

25. The method of claim 20, further comprising removing a waste toner tank from the waste toner chute to remove the waste toner from the image forming device.

26. The method of claim 25, further comprising positioning a shutter across the waste toner chute when removing the waste toner tank.

* * * * *